US006269602B1

(12) United States Patent
Thooft et al.

(10) Patent No.: US 6,269,602 B1
(45) **Date of Patent: *Aug. 7, 2001**

(54) COMBINATION REINFORCEMENT FOR FLOOR ON PILES

(75) Inventors: Hendrik Thooft, Zingem (BE); Volker Henke, Braunschweig; Manfred Teutsch, Koenigslutter, both of (DE); Ulrich Gossla, Moka (JP)

(73) Assignee: N.V. Bekaert S.A., Zwevegem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 09/308,648

(22) PCT Filed: Feb. 4, 1998

(86) PCT No.: PCT/EP98/00719

§ 371 Date: Dec. 13, 1999

§ 102(e) Date: Dec. 13, 1999

(87) PCT Pub. No.: WO98/36138

PCT Pub. Date: Aug. 20, 1998

(30) Foreign Application Priority Data

Feb. 12, 1997 (EP) ..... 97200394

(51) Int. Cl.[7] ..... E04B 5/43; E04B 5/14
(52) U.S. Cl. ..... 52/299; 52/169.9; 405/231
(58) Field of Search ..... 405/229, 231, 405/232; 52/169.9, 771.15, 299

(56) References Cited

U.S. PATENT DOCUMENTS

| | | | | |
|---|---|---|---|---|
| 776,419 | * | 11/1904 | Platt | 52/169.9 |
| 1,363,273 | | 12/1920 | Ruff . | |
| 2,413,562 | | 12/1946 | Henderson . | |
| 2,998,216 | | 8/1961 | Hurd . | |
| 3,087,308 | * | 4/1963 | Hart et al. | 52/169.9 |
| 3,184,893 | * | 5/1965 | Booth | 405/229 |
| 3,706,168 | | 12/1972 | Pilish . | |
| 3,918,229 | | 11/1975 | Schweinberger . | |
| 4,007,568 | | 2/1977 | Soble . | |
| 4,031,687 | * | 6/1977 | Kuntz | 52/169.9 |
| 4,275,538 | | 6/1981 | Bounds . | |
| 4,594,825 | | 6/1986 | Lamarca . | |
| 4,799,348 | * | 1/1989 | Brami et al. | 52/169.9 |
| 4,886,399 | * | 12/1989 | Pidgeon | 405/229 |
| 4,899,497 | * | 2/1990 | Madl, Jr. | 52/169.9 |
| 5,337,533 | | 8/1994 | Kajita . | |
| 5,367,845 | | 11/1994 | Hartling . | |
| 5,699,643 | * | 12/1997 | Kinard | 405/229 |

FOREIGN PATENT DOCUMENTS

| | | |
|---|---|---|
| 29 52 783 | 7/1981 | (DE) . |
| 0 121 003 | 10/1984 | (EP) . |
| 1105259 | 11/1955 | (FR) . |
| 2112508 | 6/1972 | (FR) . |
| 2160180 | 6/1973 | (FR) . |
| 2220643 | 10/1974 | (FR) . |
| 252975 | 6/1926 | (GB) . |
| WO 95/35415 | 12/1995 | (WO) . |
| WO 98/36138 | 8/1998 | (WO) . |

OTHER PUBLICATIONS

European Search Report (Application No. EP 98 20 1955).

* cited by examiner

*Primary Examiner*—David Bagnell
*Assistant Examiner*—Frederick L Lagman
(74) *Attorney, Agent, or Firm*—Shlesinger, Arkwright & Garvey LLP

(57) ABSTRACT

A fixed construction (10) comprises rigid piles (12) and a monolithic concrete floor slab resting (14) on the piles. The floor slab comprises straight zones connecting in two directions, ie. lengthwise and broadwise, the shortest distance between the areas of the floor slab above the piles. The floor slab (14) is reinforced by a combination of: (a) fibres (22) distributed over the volume of the floor slab (14); and (b) steel bars (16, 16') located in those straight zones. This construction reduces considerably the amount of reinforcement steel, increases the bearing capacity and enables to reduce the time for making such a construction.

18 Claims, 6 Drawing Sheets

COMBINATION REINFORCEMENT FOR FLOOR ON PILES

FIELD OF THE INVENTION

The present invention relates to a fixed construction which comprises rigid piles and a monolithic concrete floor slab.

BACKGROUND OF THE INVENTION

Concrete industrial floor slabs usually rest via a foundation layer on a natural ground. Unevenly distributed loads on top of the floor slab are transmitted via the floor slab and the foundation layer in a more evenly distributed form through to the natural ground, which eventually bears the load.

Natural grounds of an inferior quality, e.g. characterized by a Westergaard K-value of less than 10 MPa/m, are first dug up and/or tamped down and leveled before the foundation is laid over it.

Due to the fact that a lot of acceptable natural grounds have already been taken for existing constructions, the number natural grounds with inferior or even unacceptable quality which are being considered for constructions is increasing. The bearing capacity of some grounds is so bad that digging up and/or and/or excavating and/or tamping down would constitute an enormous amount of work and cost. In such a case it is known to rest the floor slab on driven or bored piles. Placing a floor slab on driven or bored piles under load, however, creates very high negative peak moments in the areas above these piles and relatively much lower (about one fifth of the height of the peak moments) positive moments in the zones between the piles. Reinforcing floor slabs on driven or bored piles with uniformly distributed steel fibres would not be economical since the zones between the piles would have a quantity of steel fibres which is unnecessarily too high and which would cause trouble during the pumping and pouring of the concrete and would render the solution not economical.

This problem has been solved in FR 2 718 765 of applicant, by having the floor slab rest on a number of gravel columns. As has been explained therein, these gravel columns are not as rigid as common piles and compress relatively easily under a downward load (the compression modulus of gravel columns e.g. ranges from 0.2 to 0.4 MN/cm) so that the gravel columns function like a spring in a mathematical model, which means that the floor slab is no longer subjected to high bending deformations in the zones above the columns.

SUMMARY OF THE INVENTION

The present invention provides an alternative reinforcement for concrete floor slabs resting on piles which saves weight of steel and which prevents the introduction of high amounts of steel fibres into the floor slab. Another object of the present invention is to provide a reinforcement for concrete floor slabs resting on piles where the reinforcement functions as a tensile anker for taking up shrinkage cracks. Still another object of the present invention is to save time when constructing a concrete floor slab resting on piles.

According to the present invention there is provided a fixed construction which comprises rigid piles and a monolithic concrete floor slab which rests on the piles. The rigid piles are arranged in a regular rectangular pattern, i.e. each set of four piles forms a rectangle. The floor slab comprises straight zones which connect the shortest distance between the areas of the floor slab above the piles. The width of such zones ranges from 50% to 500% the largest dimension of the piles. These straight zones run both lengthwise and broadwise. The term "lengthwise" refers to the direction of the longest side and the term "broadwise" refers to the direction of the smallest side. If, such as is often the case, the longest side is about equal to the shortest side, the terms broadwise and lengthwise are arbitrarily designated to the two directions.

The floor slab is reinforced by a combination of:

(a) fibres which are distributed over the volume of the floor slab;

(b) steel bars which are located in those straight zones, and preferably only in those straight zones, which means that outside these zones there is no substantial reinforcement except for the fibres under (a).

The term "rigid piles" refers to piles the compression modulus of which is much greater than the compression modulus of gravel colums and is much greater than 10 MN/cm. These rigid piles are driven or bored piles and may be made of steel, concrete or wood. They may have a square cross-section with a side of 20 cm or more, or they may have a circular cross-section with a diameter ranging between 25 cm and 50 cm. The distance between two adjacent piles may vary from 2.5 m to 6 m.

By using this combination reinforcement constituted by fibres and a classical steel bar reinforcement which is only located in the critical points of the floor slab, it has proved to be possible to limit the total amounts of steel in the concrete slab from about 120 kg/m$^3$ (=1.53 vol. %) until about 50 kg/m$^3$ (=0.64 vol. %) to 60 kg/m$^3$ (=0.77 vol. %), or even lower.

The floor slab is an industrial floor with dimensions up to 60 m×60 m and more, and—due to the continuous bar reinforcement—carried out without joints, i.e. without control joints, isolation joints, construction joints or shrinkage joints.

Of course, in order to cover large surfaces more than one such a jointless floor slab may be put adjacent to each other. The thickness of the floor slab may range from about 14 cm to 35 cm and more.

Preferably the floor slab "directly" rests on the piles. This refers to a floor slab which rests on the piles without any intermediate beams or plates. All reinforcement is embedded in the floor slab itself.

The fibres in the floor slab are preferably uniformly distributed in the concrete of the floor slab. The fibres may be synthetic fibres but are preferably steel fibres, e.g. steel fibres cut from steel plates or, in a preferable embodiment, hard drawn steel fibres. These fibres have a thickness or a diameter varying between 0.5 and 1.2 mm, and a length-to-thickness ratio ranging from 40 to 130, preferably from 60 to 100. The fibres have mechanical deformations such as ends as hook shapes or thickenings in order to improve the anchorage to the concrete. The tensile strength of the steel fibres ranges from 800 to 3000 MPa, e.g. from 900 to 1400 MPa. The amount of steel fibres in the floor slab of the invention preferably ranges from 35 kg/m$^3$ (0.45 vol. %) to 80 kg/m$^3$ (1.02 vol. %), e.g. from 40 kg/m$^3$ (0.51 vol. %) to 65 kg/m$^3$ (0.83 vol. %). So the amount of steel fibres in a concrete floor slab according to the invention is preferably somewhat higher than steel fibre reinforced floors on natural ground of good quality (normal amounts up to 35 kg/m$^3$), but can be kept within economical limits due to the combination with the steel bar reinforcement.

The other steel reinforcement in addition to the steel fibres, the steel bars, occupy maximum 0.5% of the total volume of the floor slab, e.g. maximum 0.4%, e.g. only 0.2% or 0.3%.

Both steel reinforcements, the steel fibres and the steel bars, preferably occupy maximum 1.5% of the total volume of the floor slab, e.g. maximum 1.0%.

In a preferable embodiment of the present invention, the steel bars form a cage reinforcement, i.e. a three-dimensional steel structure inside the floor slab. This cage reinforcement comprises stirrups which connect the steel bars and form the three-dimensional structure. Due to the combination with the steel fibres, the distance between two successive stirrups may be increased above 50 cm.

BRIEF DESCRIPTION OF THE DRAWINGS

The invention will now be described into more detail with reference to the accompanying drawings wherein.

DESCRIPTION OF A PREFERRED EMBODIMENT OF THE INVENTION

Figure 1:
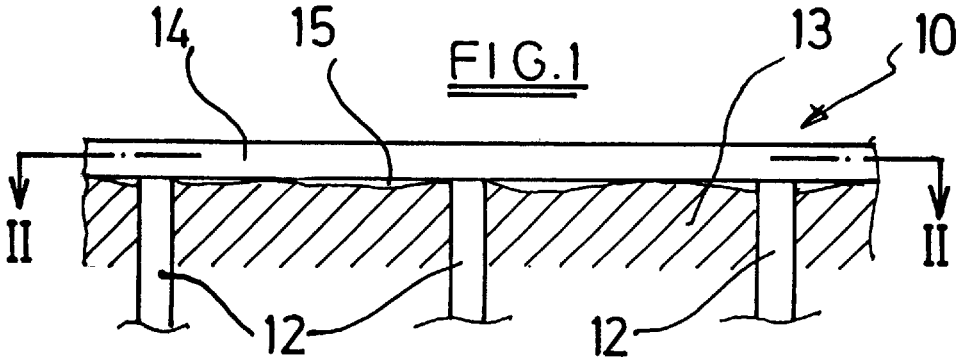
FIG. 1 is a transversal cross-section of a fixed construction according to the invention according to line I—I of FIG. 2.

Referring to FIG. 1, a fixed construction according to the invention comprises rigid piles 12 which are driven or bored into the natural ground 13. A concrete floor slab 14 directly rests on the piles 12. i.e. without any intermediate plate or beam. The invention is particularly interesting for use on natural grounds of an inferior quality, i.e. with a Westergaard K-value of less than 10 MPalm. In course of time, such natural grounds settle to a relatively high degree and no longer provide an adequate support for the floor slab 14. This is outlined by a distance 15 in FIG. 1. So the piles 12 remain the only reliable support for the floor slab 14.

Figure 2:
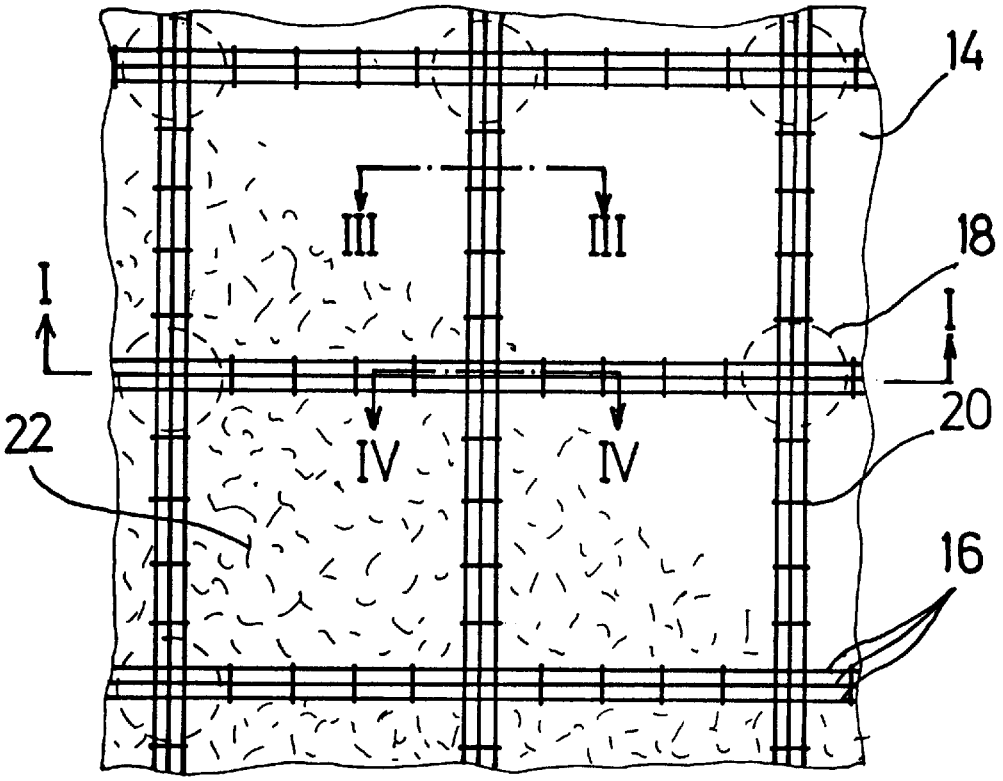
FIG. 2 is a cross-sectional view of the fixed construction according to line II—II of FIG. 1.
Figure 5:
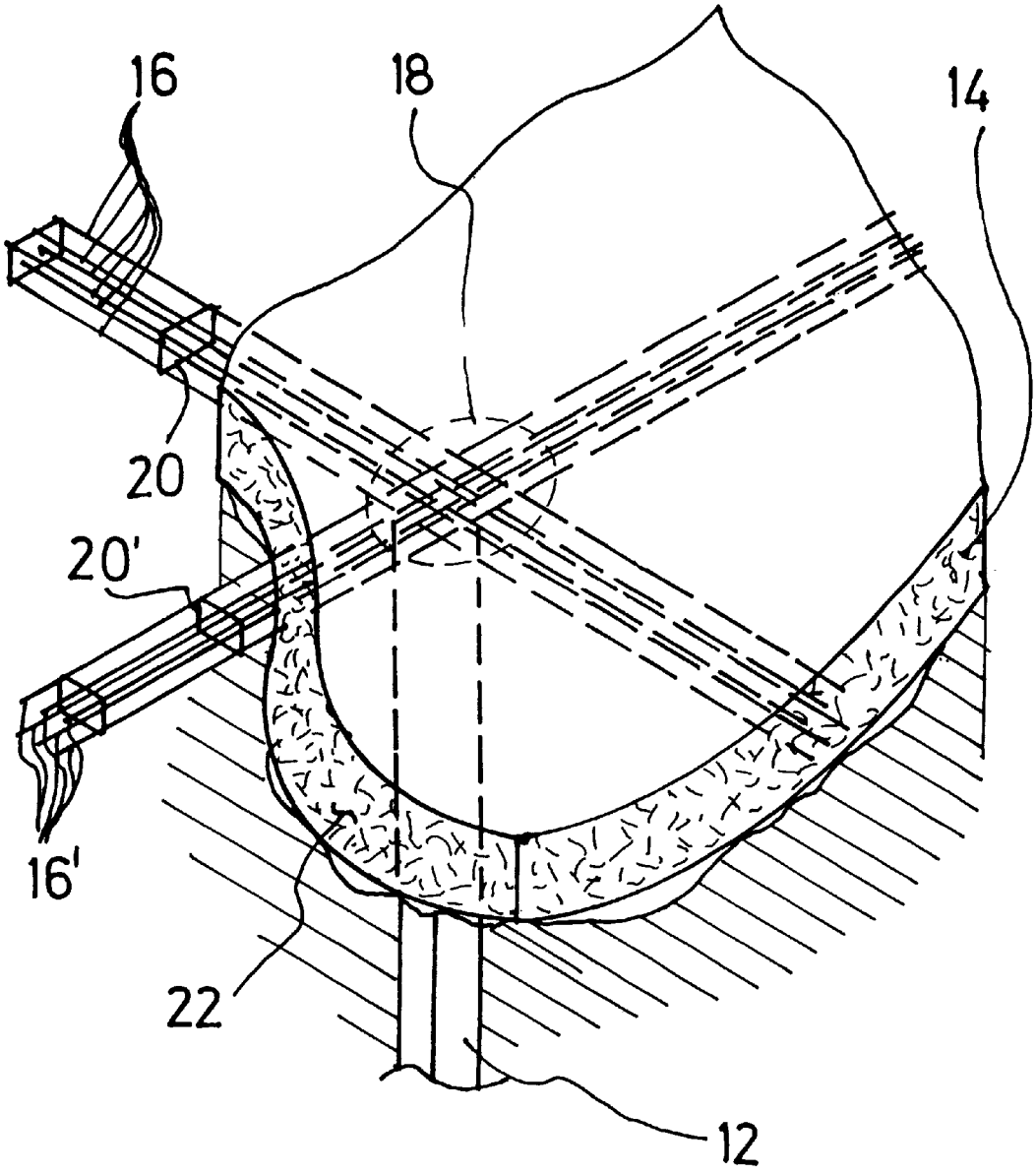
FIG. 5 gives a perspective cross-sectional view of a fixed construction according to the invention.

FIG. 2 and FIG. 5 illustrate where the bar reinforcement is located in the floor slab 14. Steel bars 16, running lengthwise, and steel bars 16', running broadwise, connect the shortest distance above those areas 18 of the floor slab which are situated above the piles 12. So the steel bars not only reinforce the limited areas 18 above the piles 12 but also the zones between the piles 12. This is remarkable since as has been explained hereabove, the moments occurring between the piles are not as high as those occuring in the zones above the piles. Experiments have proved, however, that reinforcing the straight zones between the piles as in the present invention, helps to stop and limit cracks which are a consequence of shrinkage of the concrete of the floor slab or which are a consequence of loads on the floor slab. More particularly, reinforcing the straight zones between the piles and placing the floor slab under increasing loads, leads to a pattern where the cracks are more spread and multiplied in comparison with a floor slab where only steel fibres are present as reinforcement. Due to this spreading and multiplication, the cracks are limited and are less harmful.

Figure 3:
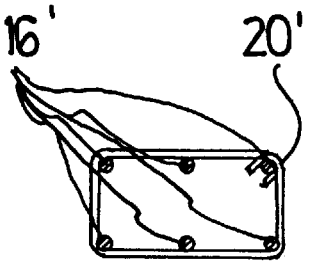
FIG. 3 is a cross-sectional view of a steel cage reinforcement according to line III—IIII of FIG. 2.
Figure 4:
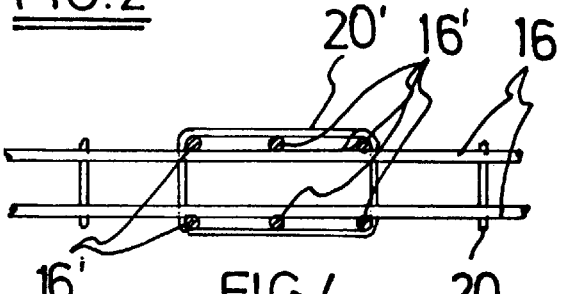
FIG. 4 is a cross-sectional view of a steel cage reinforcement according to line IV—IV of FIG. 2.

FIGS. 3 and 4 illustrate the cage reinforcement which is built by the steel bars 16 and 16'.

FIG. 3 illustrates the cage reinforcement in the direction broadwise and FIG. 4 illustrates how the cage reinforcements lengthwise and broadwise cross each other.

Referring to FIG. 3, six steel bars 16' run parallel to each other and form in transversal cross-section a rectangular. Another number of steel bars 16', e.g. four or eight, is also possible. At discrete distances, e.g. every 50 cm or 100 cm, stirrups 20 ' connect the steel bars 16' and form the three-dimensional steel cage. The steel bars 16' have a diameter of e.g. 12 mm (generally the diameter of the steel bars may be up to 20 mm) while the diameter of the wires forming the stirrups 20 ' may be somewhat lower, e.g. 6 to 8 mm.

It is a supplementary advantage of the present invention that due to the presence of the steel fibres the distance between two stirrups 20, 20' may be increased from e.g. 50 cm to 100 cm.

Coming back to FIGS. 2 and 5, steel fibers or fibers 22 are distributed, preferably as uniformly as possible in the two horizontal directions over the whole volume of the floor slab 14.

A fixed construction 10 according to the invention can be made as follows. Rigid piles 12 are driven or bored into the natural ground 13. The natural ground 13 is leveled and the cage reinforcement 16-20-16'-20' is placed where the straight zones as defined hereabove are to come. Finally, concrete with steel fibres 22 is pumped and poured over the designed area.

The concrete used may be conventional concrete varying from C20/25 to C40/50 according to the European norms (EN 206). The characteristic compressive strength after 28 days of such a concrete varies between 20 MPa and 40 MPa if measured on cylinders (300×Ø150 mm ) and between 25 and 50 MPa if measured on cubes (150×150×150 mm).

After being poured the concrete is first leveled and then left to harden. The finishing operation may comprise the power floating of the surface in order to obtain a flat floor with a smooth surface and may also comprise applying a topping (e.g. dry shake material) over the hardening floor slab and curing the surface by means of waxes (curing compounds). The hardening may take fourteen days or more during which no substantial loads should be put on the floor slab.

In comparison with a concrete floor slab where only steel fibres have been used as a reinforcement, a fixed construction according to the invention has led to a construction with an increased bearing capacity and/or to a construction where the distance between the supporting piles may be increased.

The inventors have discovered that with the combination reinforcement according to the invention, there is no need to place additional reinforcements such as still some more steel bars or steel meshes in the areas of the floor slab above the piles.

The inventors have also discovered that with the combination reinforcement according to the invention there is no need to construct the piles with an increased cross-section at their top and that there is neither a need to construct separate pile heads with an increased cross- section.

Such increased cross-sections just under the floor slab are used in existing constructions to diminish the transversal forces of loads on the slab. The present invention decreases this necessity.

Comparison Test

A fixed construction according to the invention has been tested and compared with a reference construction at the Institut für Baustoffe, Massivbau und Brandschutz (iBMB) of the Technische Universitäat Braunschweig.

Figure 6:
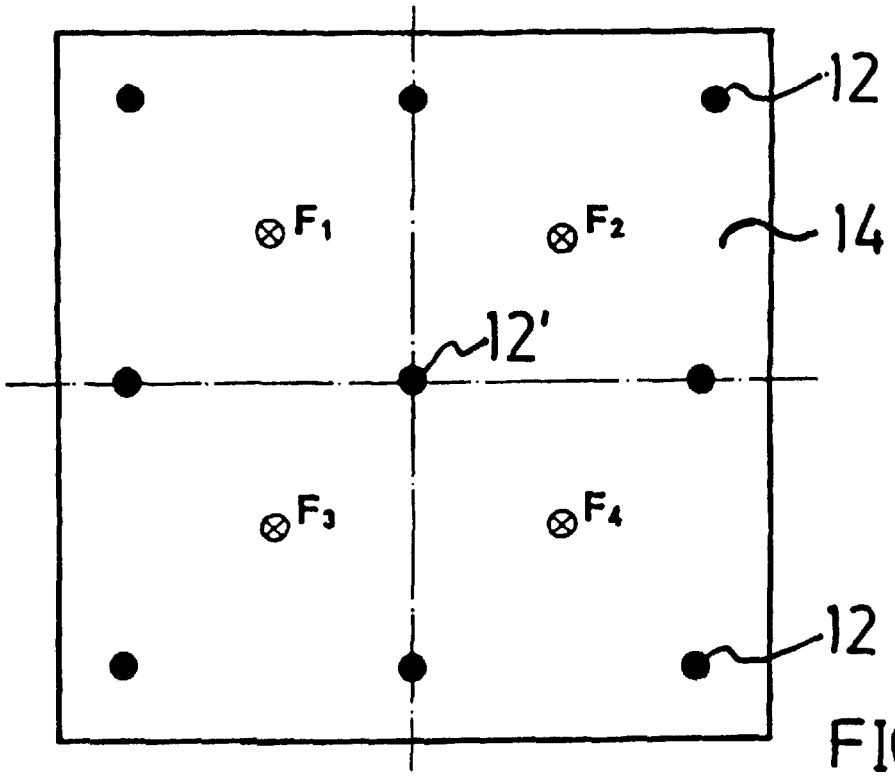
FIG. 6 gives an upper view of a set-up where the invention has been compared with a reference fixed construction.
Figure 7:
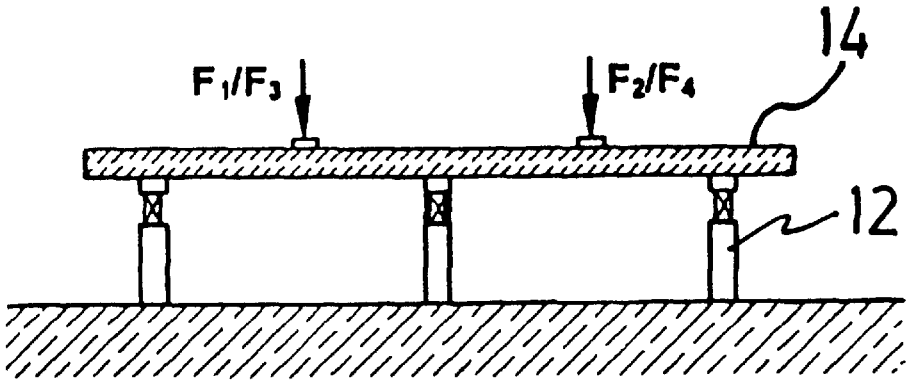
FIG. 7 gives a side view of the set-up of FIG. 6.

FIG. 6 and FIG. 7 schematically illustrate the set-up. A square concrete floor slab 14 with dimensions of 500 cm×500 cm rests directly on nine rigid piles 12. The distance between two nearest piles 12 is 200 cm. Except for the central pile 12', the other piles are located at 50 cm from the border of the concrete floor slab 14. The thickness of the concrete floor slab 14 is 14 cm. The height of the piles 12 is 80 cm. The diameter of the piles is 20 cm.

The composition of the concrete floor slab 14 of the invention and the one of the reference construction is according the following table

| | Reference | Invention |
|---|---|---|
| concrete quality | B45 | B35 |
| steel fibres DRAMIX ® length 60 mm, 0.75 mm diameter | 40 kg/m$^3$ | 40 kg/m$^3$ |
| cement CEM I 32.5 R (PZ 35 F) Teutonia | 360 kg/m$^3$ | 360 kg/m$^3$ |
| fly ashes | 100 kg/m$^3$ | 100 kg/m$^3$ |
| water/cement ratio | 0.46 | 0.53 |
| water | 165 l/m$^3$ | 191 l/m$^3$ |
| sand Evers 0/2 | 703 kg/m$^3$ | 681 kg/m$^3$ |
| fine gravel 2/8 | 279 kg/m$^3$ | 280 kg/m$^3$ |
| small lime stone 8/16 | 766 kg/m$^3$ | 748 kg/m$^3$ |
| liquid Isola | 0.5% | 0.5% |
| retarder Isola PH | 0.2% | 0.2% |
| cage reinforcement | No | Yes 4 vol. % |

Figure 8:
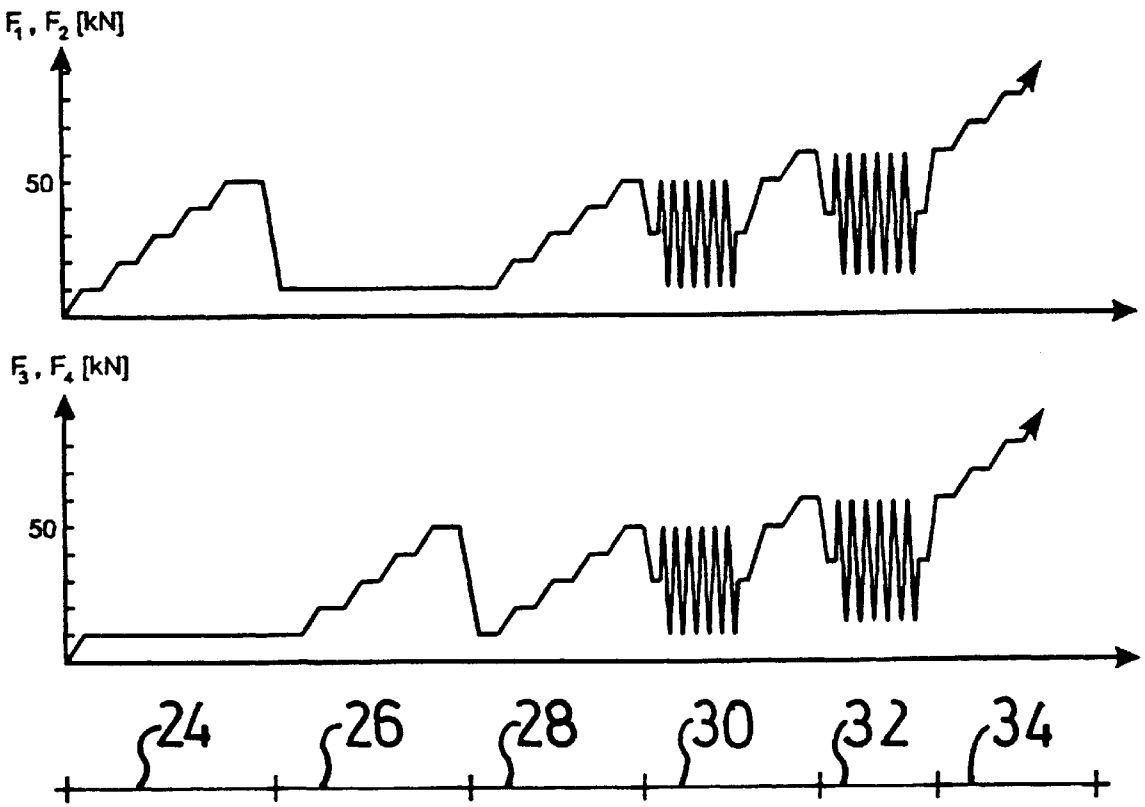
FIG. 8 illustrates the time course of various loads applied to the invention and the reference fixed construction.

The nine piles 12 from four square fields of 200 cm×200 cm. Four hydraulically generated loads $F_1$, $F_2$, $F_3$ and $F_4$ each have a point of application in the middle of each of these squares. Their course of time has been depicted in FIG. 8. During a first period 24 F1 and F2 are increased gradually to a level of 50 kN, while F3 and F4 remain at a constant level of 10 kN. During a second period 26 F3 and F4 are gradually increased while F1 and F2 remain at a constant level. During the third period 28 all loads F1, F2, F3 and F4 gradually increased until 50 kN. During a fourth period 30 and a subsequent period 32, loads F1, F2, F3 and F4 all cyclically vary between a bottom load and an upper load. For both periods 30 and 32 there are 10000 cycles. The freqeuncy of the cyles is 0.2 Hz. For period 30 the bottom load is 20 kN and the upper load 50 kN. For period 32 the bottom load is 25 kN and the upper load 60 kN. During both periods 30 and 32 time intervals are inserted for measuring, amongst others, the width and evolution of the cracks. Finally, during a last period 34, the loads are gradually increased beyond 60 kN.

The table hereunder mentions the obtained results.

TABLE

| | reference | invention |
|---|---|---|
| calculated breaking load (kN) | | |
| symmetrical fracture lines | 69.4 | 128 |
| asymmetrical fracture lines | 72.8 | 137 |
| experimental breaking load (kN) | 81.6 | 129.9 |
| bending at maximum load (mm) | 3 | 42 |

Figure 9:
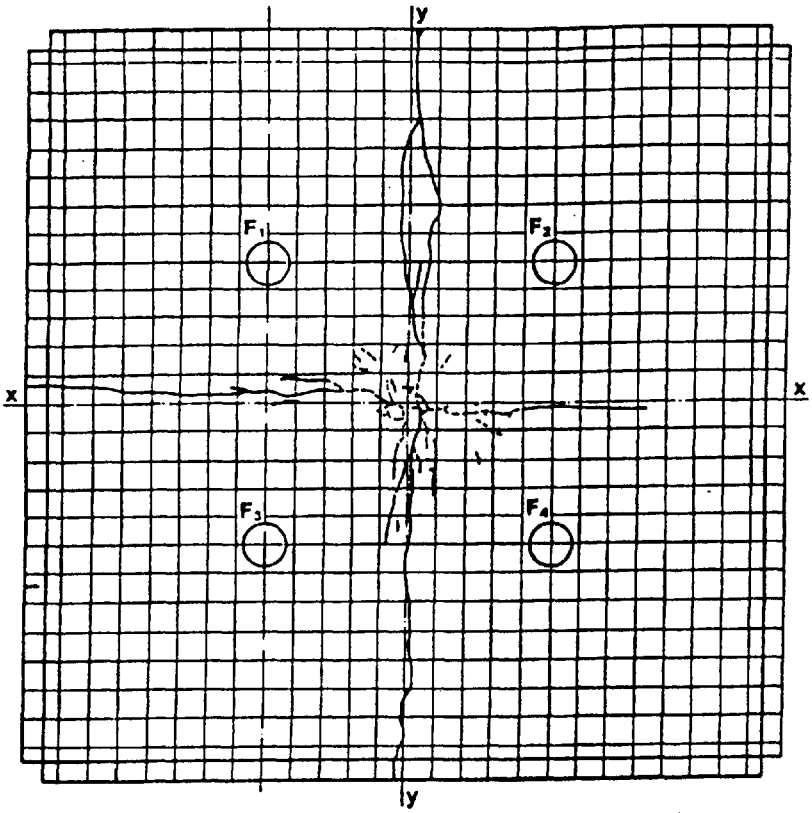
FIG. 9 shows the pattern of cracks at the upper side of a concrete floor slab of the reference fixed construction.
Figure 10:
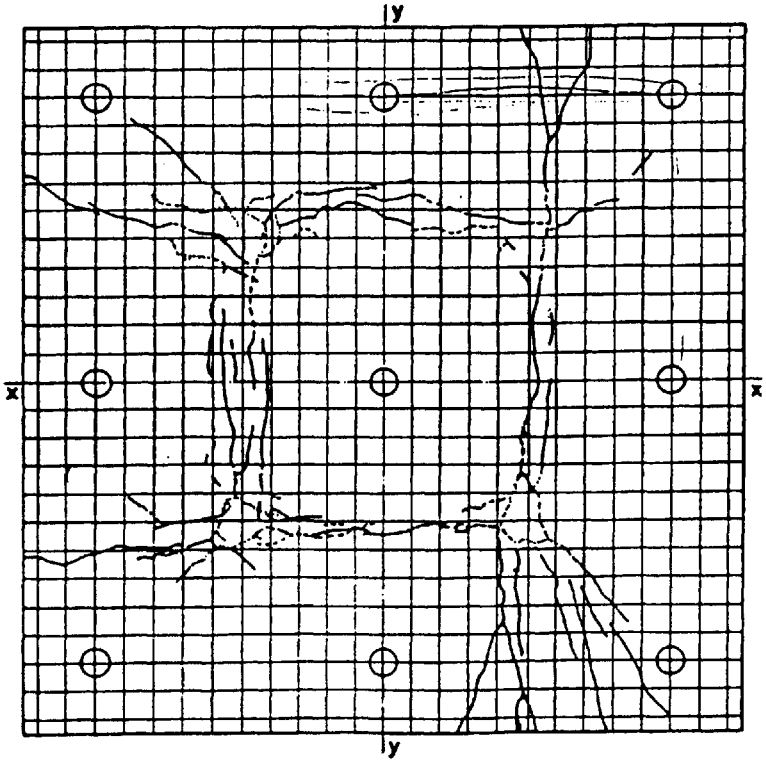
FIG. 10 shows the pattern of cracks at the bottom side of a concrete floor slab of the reference fixed construction.

The cracks, their origin and evolution are observed by means of a calibrated video system with resolution down to 1/100 mm. FIG. 9 shows the pattern of cracks at the upper side of a concrete floor slab of the reference fixed construction and FIG. 10 shows the pattern of cracks at the bottom side of a concrete floor slab of the reference fixed construction at the end of the test. Relatively broad concentrated cracks are observed. At the end of the test, the concrete floor slab shows an asymmetrical fracture line yy (FIG. 9).

Figure 11:
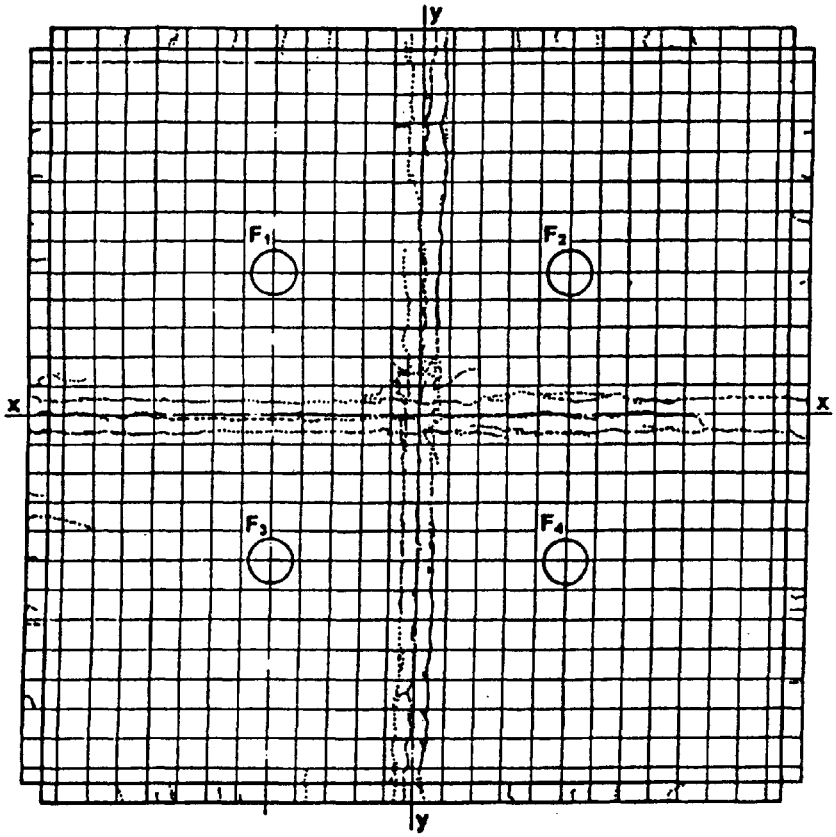
FIG. 11 shows the pattern of cracks at the upper side of a concrete floor slab of the invention.
Figure 12:
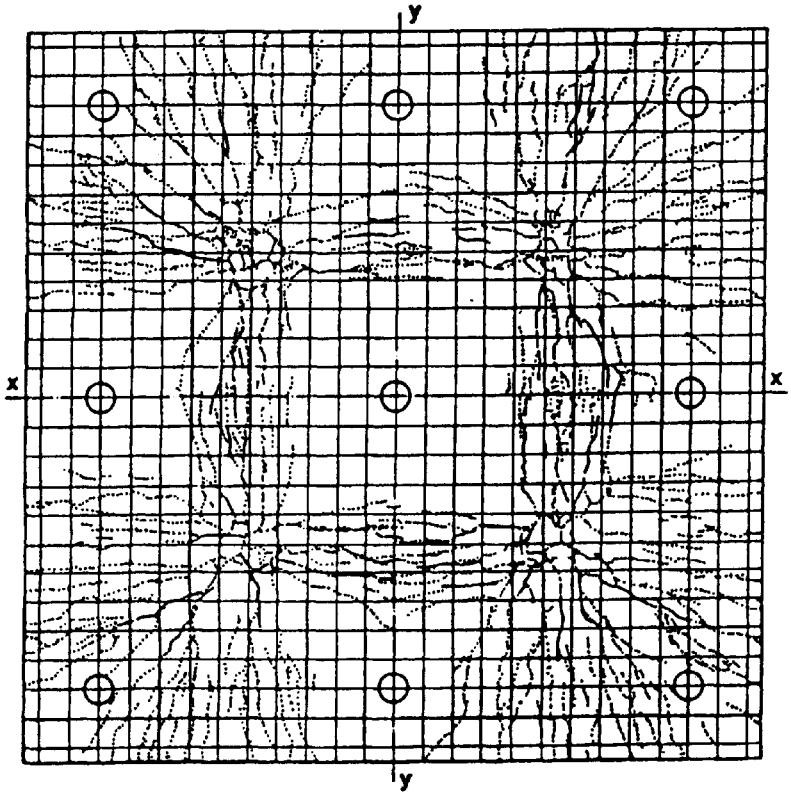
FIG. 12 shows the pattern of cracks at the bottom side of a concrete floor slab of the invention.

FIG. 11 shows the pattern of cracks at the upper side of a concrete floor slab of the invention and FIG. 10 shows the pattern of cracks at the bottom side of a concrete floor slab of the invention at the end of the test. A pattern of dispersed, relatively narrow cracks is observed. It is remarkable that the classical cage reinforcement which is only present in those straight zones above the piles, leads to a totally different pattern of cracks in zones where there is no such cage reinforcement. At the end of the test the concrete floor slab showed a symmetrical fracture pattern.

What is claimed is:

1. A fixed construction, comprising:

a) rigid piles and a monolithic concrete floor slab resting on said piles, said rigid piles being arranged in a regular rectangular pattern where each set of four piles forms a rectangles;

b) said floor slab comprising straight zones connecting sides of the rectancle defined by the four piles the straight zones being disposed in an area of the floor slab above the piles;

c) said floor slab being reinforced by a combination of:

i) fibres being distributed throughout the volume of said floor slab; and ii) steel bars being located only in said straight zones.

2. A fixed construction according to claim 1 wherein said floor slab is a jointless floor slab.

3. A fixed construction according to claim 1 wherein said floor slab directly rests on said piles.

4. A fixed construction according to claim 1 wherein said fibres are steel fibres.

5. A fixed construction according to claim 1 wherein said fibres are hard drawn steel fibres.

6. A fixed construction according to claim 1 wherein said steel bars occupy up to 0.5% of the total volume of said floor slab.

7. A fixed construction according to claim 6 wherein said steel bars occupy up to 0.4% of the total volume of said floor slab.

8. A fixed construction according to any one of claim 1 wherein said steel fibres occupy at most 80 kg/m$^3$ (=1.02 volume %) of the floor slab.

9. A fixed construction according to claim 8 wherein said steel fibres occupy at most 60 kg/m$^3$ (=0.75 volume %) of the floor slab.

10. A fixed construction according to claim 1 wherein said steel fibres and said steel bars together occupy at most 1.5 volume % of the floor slab.

11. A fixed construction according to claim 1 wherein said steel bars form a cage reinforcement.

12. A fixed construction according to claim 11 wherein said cage reinforcement comprises stirrups connecting said steel bars, the distance between two successive stirrups being greater than 50 cm.

13. A fixed construction, comprising:

a) rigid piles;

b) a concrete floor slab resting on the rigid piles;

c) four of the rigid piles being arranged in a rectangular pattern;

d) straight zones extending between adjacent ones of the four piles, the straight zones extending in lengthwise and broadwise directions;

e) fibres being distributed throughout the volume of the floor slab; and f) steel bars being provided in the floor slab, the steel bars being located only in the straight zones.

14. A fixed construction according to claim 13, wherein:

a) said steel bars include pairs of steel bars.

15. A fixed construction according to claim 13, wherein:

a) the concrete floor slab rests directly on the piles.

16. A fixed construction according to claim 13, wherein:

a) the fibres are steel fibers.

17. A fixed construction according to claim 13, wherein:

a) the steel bars define a cage reinforcement.

18. A fixed construction according to claim 17 wherein:

a) the cage reinforcement includes stirrups connecting the steel bars.

* * * * *